United States Patent [19]

Cody

[11] 4,102,108

[45] Jul. 25, 1978

[54] FASTENING MEANS FOR A LOAD-BEARING STRUCTURE

[75] Inventor: David L. Cody, Hoffman Estates, Ill.

[73] Assignee: Symons Corporation, Des Plaines, Ill.

[21] Appl. No.: 777,428

[22] Filed: Mar. 14, 1977

Related U.S. Application Data

[63] Continuation-in-part of Ser. No. 746,314, Dec. 1, 1976.

[51] Int. Cl.[2] ..... E04C 3/02; F16D 1/12

[52] U.S. Cl. ..... 52/693; 403/156; 403/388

[58] Field of Search ..... 403/388, 403, 409, 390, 403/156, 177, 178, 408; 52/632, 645, 646, 263, 122, 690–693, 641, 643, 646

[56] References Cited

U.S. PATENT DOCUMENTS

| | | | |
|---|---|---|---|
| 1,409,007 | 3/1922 | Johnston | 403/156 |
| 2,177,043 | 10/1939 | Moths | 52/693 |
| 2,578,397 | 12/1951 | Brown | 403/390 |
| 3,415,554 | 12/1968 | Papayoti | 403/388 |

FOREIGN PATENT DOCUMENTS

| | | | |
|---|---|---|---|
| 633,673 | 1/1962 | Canada | 52/632 |
| 1,526,182 | 3/1967 | France | 52/645 |
| 464,875 | 7/1951 | Italy | 403/408 |

*Primary Examiner*—James L. Ridgill, Jr.
*Attorney, Agent, or Firm*—Norman H. Gerlach

[57] ABSTRACT

Fastening means are employed in a load-bearing structure, such structure including structural members adjacent to each other at two spaced apart points, the fastening means being of the threaded bolt and nut type serving to connect the structural members together and to transfer load forces between the members at both points, and including a bolt and a nut each having a head and an integral shank including a cylindrical bearing portion, such shanks being inserted through bolt holes in the structural members and the shank bearing portions being in load-bearing engagement with the members at respective points.

14 Claims, 9 Drawing Figures

FASTENING MEANS FOR A LOAD-BEARING STRUCTURE

RELATED APPLICATION

This is a continuation-in-part of my copending application Ser. No. 746,314 filed Dec. 1, 1976 for "Adjustable Shoring Apparatus".

BACKGROUND OF THE INVENTION

This invention relates to fastening means for a load-bearing structure. More particularly, the invention relates to fastening means of the bolt and nut type which are employed with structural members adjacent to each other at two spaced apart points and which serve to connect the members together and to transfer load forces between the members at both points.

In load-bearing truss systems and the like, structural members frequently are connected to other structural members at spaced apart points for transfer of load forces therebetween. Examples include the use of tubular struts in the truss systems and their connection to chord means having walls or webs disposed on opposite sides of the struts. Structures of this type, which employ rectangular tubular chords as well as rectangular tubular struts, are disclosed in U.S. Pat. No. 3,826,057. Other structures similarly employ rectangular tubular struts and pairs of channel-shaped chords secured on opposite sides of the struts. In such structures, the structural members are connected together by bolts having elongated shanks with bearing diameters for supporting the structural members thereon, and clamping nuts, as illustrated in FIG. 20 of the foregoing patent, or by multiple standard bolts and nuts serving to clamp adjacent walls or webs together.

The use of standard bolts and nuts is accompanied by several disadvantages: connections for load transfer are made by tightening the fasteners, placing the fasteners under relatively high axial tension and requiring a large thread for structural integrity. More care is required for proper assembly, more fasteners are required, and more effort is involved in assembly and disassembly.

The type of fastener employed in the patent identified above obviates disadvantages of the standard fasteners but suffers from certain other disadvantages. Thus, as illustrated in FIG. 20 of the patent, load forces are transferred between the structural members at the bolt shank (129), in shear. There is the risk, however, that full bearing support on the shank will not be achieved, such as when the bolt is not inserted fully or when dimensional variations are encountered. Another disadvantage is that the bolts have to be worked through a succession of holes at spaced apart locations, which may be time-consuming with structural members out of alignment, and the close-fitting shank must be pushed entirely through the walls or webs near the bolt head. The assembly operation may be injurious to the bolt thread. As illustrated in FIG. 19 of the patent, a drift pin is employed to align the structural members and protect the thread, and it must be placed on and removed from each bolt that is inserted in the structure.

SUMMARY OF THE INVENTION

An important object of the present invention is to provide a load-bearing structure of structural members and fastening means which achieves reliable, complete bearing engagement of structural members with fastening means at spaced apart points for purpose of transmitting load forces therebetween.

Another important object is to provide a load-bearing structure of structural members and fastening means which may be assembled rapidly, with greater ease, and without damage to fastener threads.

Another object is to eliminate the need for a separate drift pin for the fastening means and the labor required in connection with its use.

A specific object is to provide fastening means of the bolt and nut type for a load-bearing structure, each of the bolt and nut components of which includes a bearing portion for transferring load forces between structural members in engagement therewith.

A more specific object is to provide fastening means of the foregoing character in which each of the bolt and nut shanks includes a cylindrical bearing portion and a tapered drift portion, the drift portions serving to align bolt holes at spaced points in a structure.

In the invention, fastening means are employed in a load-bearing structure which includes structural members adjacent to each other at each of two spaced apart points and a circular bolt hole in each member at each point and registering with the other bolt holes for receiving in the registering bolt holes threaded bolt and nut-type fastening means serving to connect the members together and to transfer load forces between the members at both points, the fastening means being inserted in the registering bolt holes and comprising a bolt having a head, a shank integral with the head and projecting axially therefrom, the shank including a bearing portion of reduced diameter, and a threaded stem of further reduced diameter projecting axially from the shank, and a nut having a head, and a shank integral with the nut head and projecting axially therefrom, the nut shank including a cylindrical bearing portion of reduced diameter the same as the diameter of the bolt shank bearing portion, the nut head and shank having a threaded bore extending axially therethrough and adapted for receiving the stem in threaded engagement with the nut; the bolt shank being inserted through the bolt holes in the structural members at one of said points in load-bearing engagement of its bearing portion with the members, and the nut shank being inserted through the bolt holes in the structural members at the remaining point in load-bearing engagement of its bearing portion with the members, and the nut receiving the stem in threaded engagement in the bore. In a preferred construction, the bolt shank and the nut shank each include an outer conically tapered drift portion.

Other objects, advantages and features of the invention will become apparent from the following description of preferred embodiments of the invention, taken in conjunction with the accompanying drawings.

BRIEF DESCRIPTION OF THE DRAWINGS

The attached drawings illustrate a preferred embodiment of the invention, without limitation thereto. In the drawings, like elements are identified by like reference numerals in each of the views, and.

DESCRIPTION OF THE PREFERRED EMBODIMENTS

Figure 1:
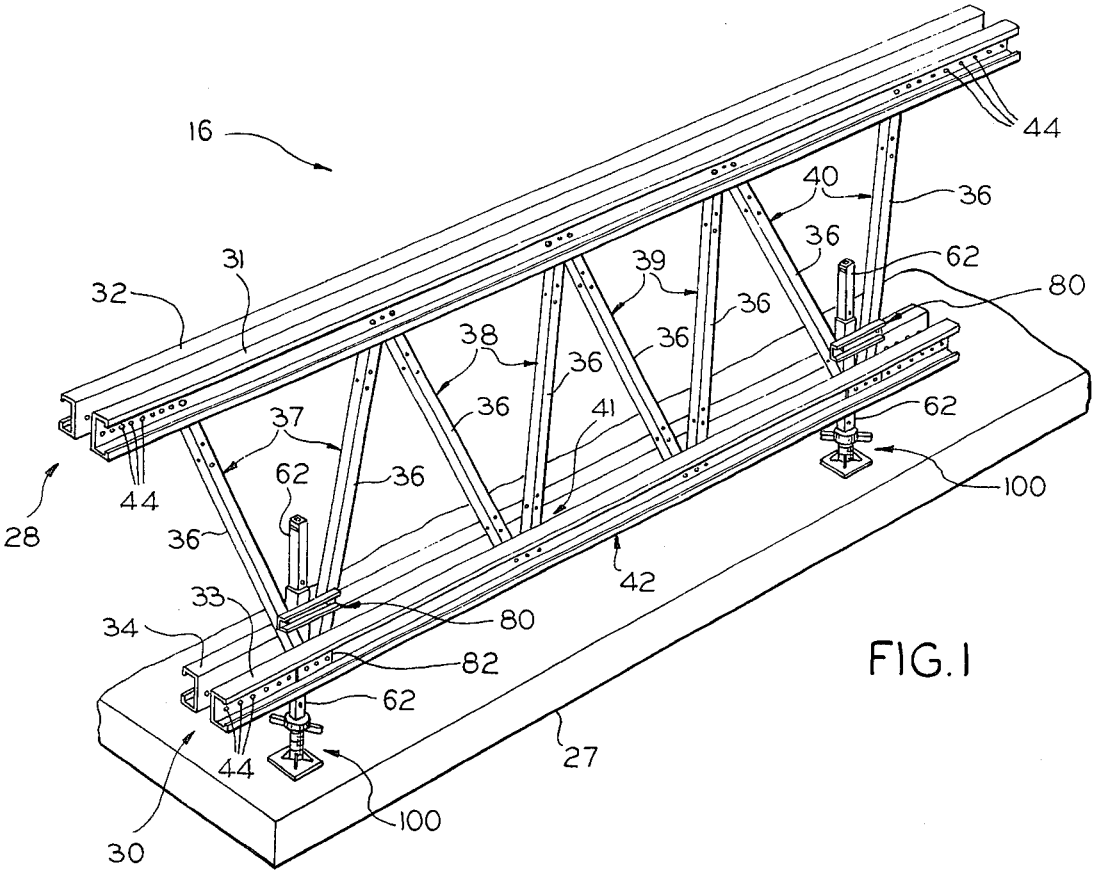
FIG. 1 is a perspective view of a shoring apparatus unit embodying the invention.
Figure 2:
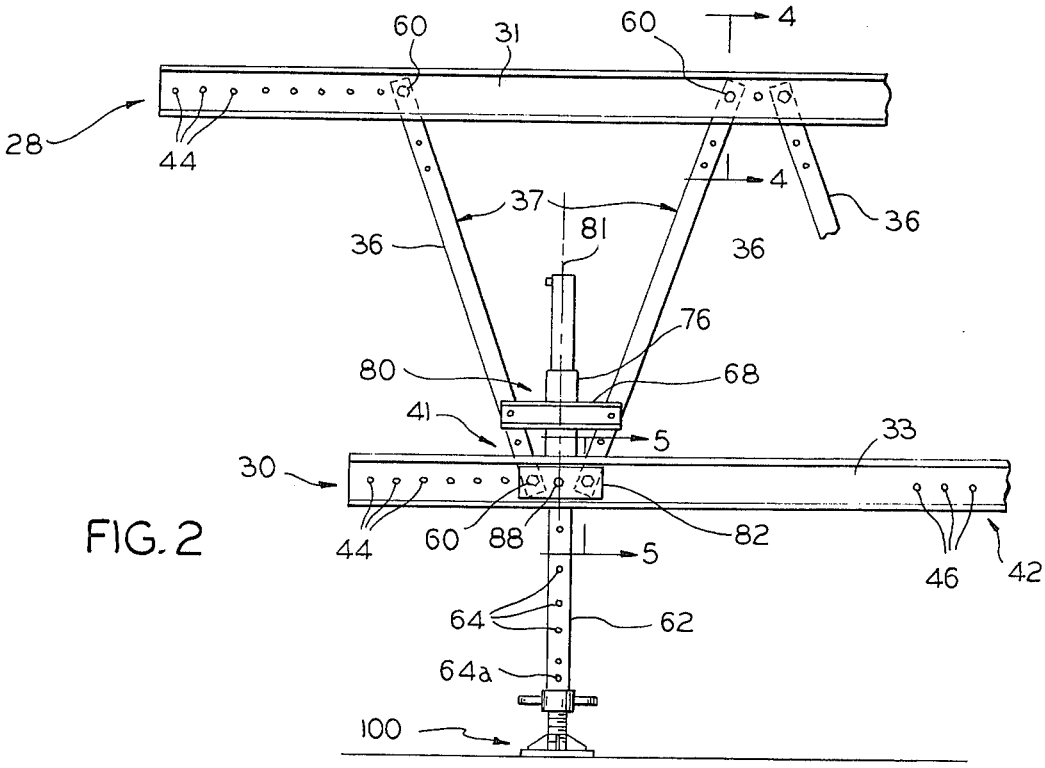
FIG. 2 is an enlarged fragmentary side elevational view of the unit illustrated in FIG. 1.
Figure 3:
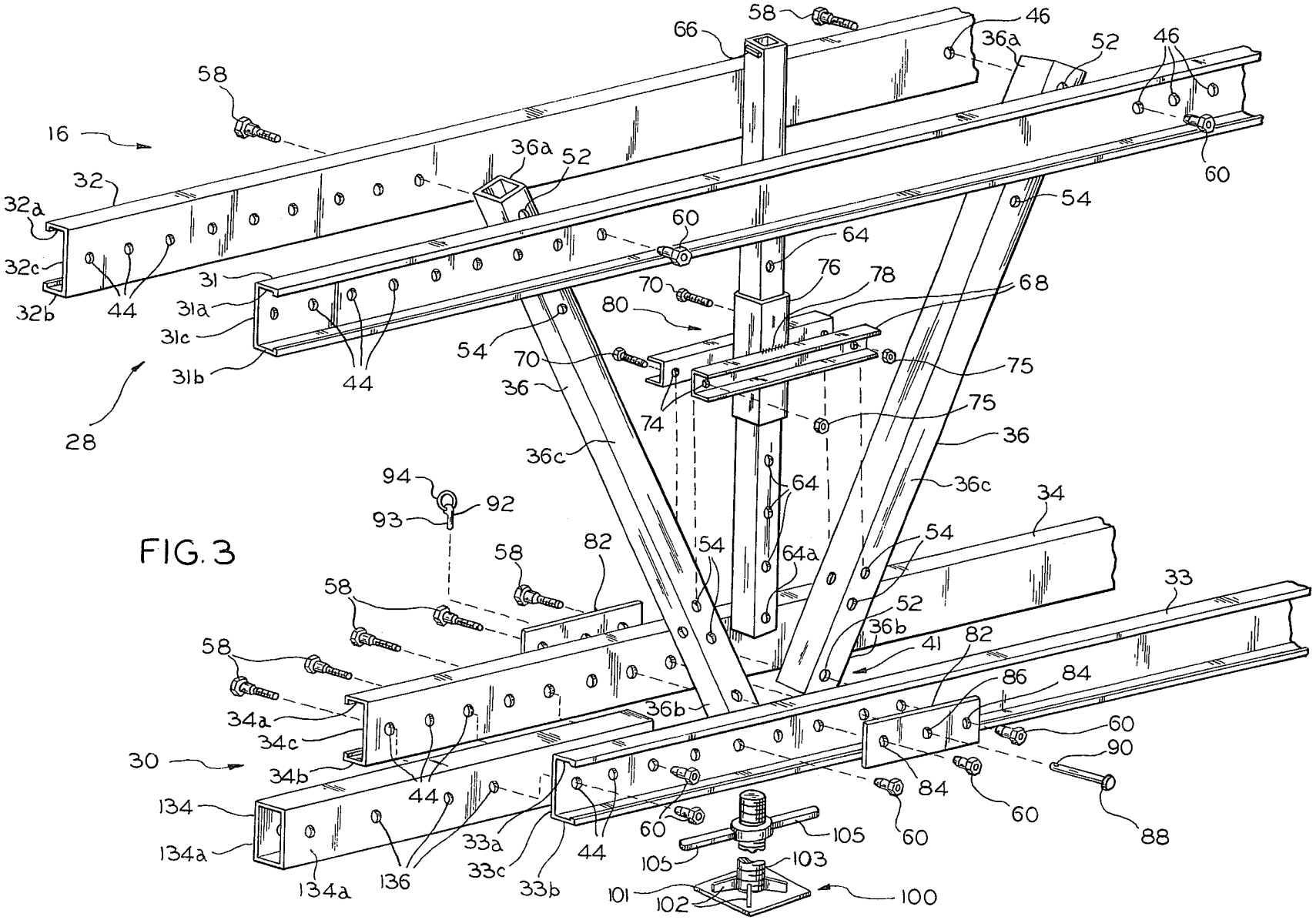
FIG. 3 is a further enlarged fragmentary exploded perspective view of the structure illustrated in FIG. 2 and an additional member.

Referring to the drawings, FIGS. 1–3 illustrate an elongated shoring apparatus unit 16, which is adapted for use as such or joined to other similar units, in parallel and/or in series relation. The illustrative unit may be employed, for example, for the support of a concrete beam form. A pair of like units in parallel relation may be employed in a concrete form installation unit of the flying deck type, wherein the units 16 are joined together and surmounted by a formwork unit connected thereto.

The shoring apparatus unit 16 is assembled for use on a foundation or floor slab 27. A concrete beam form or the like, not illustrated, may be supported on the unit. After concrete is poured and allowed to harden, to form a beam, the unit 16 with attached formwork is lowered from the beam or collapsed, and then removed for use in another location. The unit 16, with the exception of certain screw jacks thereof, is adapted to be transported completely, as a unit, with or without a formwork unit secured on top thereof, both on a supporting surface and from one elevation to another.

The shoring apparatus unit 16 is constructed of an upper pair 28 and a lower pair 30 of spaced apart parallel channel-shaped chords 31,32 and 33,34, respectively, having horizontally extending longitudinal axes. Rectangular tubular struts 36, which have square cross sections in the illustrative embodiment, extend obliquely from the upper chord pair 28 to the lower chord pair 30 and between the chords in each pair, in a continuous longitudinal series of four strut pairs 37–40 (FIG. 1) of like substantially V-shaped configuration having their apices 41 at the lower chord pair 30. The respective upper and lower ends **36*a* and 36*b* of the struts 36 are connected to the chords 31,32 and 33,34 of the upper and lower pairs 28 and 30, respectively, in a truss-like structure 42 by means subsequently described, which structure is adapted for supporting a load on the chords 31,32 of the upper pair 28**.

The chords 31–34 are structurally identical, differing only in length in the illustrative embodiment, and may be used as upper or lower chords, as required. Referring to the lower chord 33 illustrated in FIG. 3 as representative, the chord includes upper and lower flanges **33*a* and 33*b* extending horizontally outwardly at right angles from a vertically extending integral web or wall 33*c*. The web 33*c* is provided with a group of nine equidistantly spaced circular bolt holes 44 in an axial row adjacent to each of the opposite ends of the chord 33. At equidistantly spaced intervals along the chord 33, intermediate groups of three equidistantly spaced circular bolt holes 46 (FIG. 2) are provided in the web 33*c*, and they have the same spacing as the bolt holes 44 in the end groups. There are three of such intermediate groups of bolt holes 46 in the upper chords 31 and 32, and two of such intermediate groups in the lower chords 33 and 34. The bolt holes 44 and 46 in each chord of a pair are in transverse register or alignment with the corresponding holes of the remaining chord of the pair. As seen in FIGS. 1 and 2, the upper chord pair 28 extends longitudinally outwardly beyond the lower chord pair 30 at both ends thereof, and the groups of bolt holes 44 and 46 in the upper chord pair 28 are in longitudinally offset or staggered relation to the groups of bolt holes 44 and 46 in the lower chord pair 30**.

Figure 4:
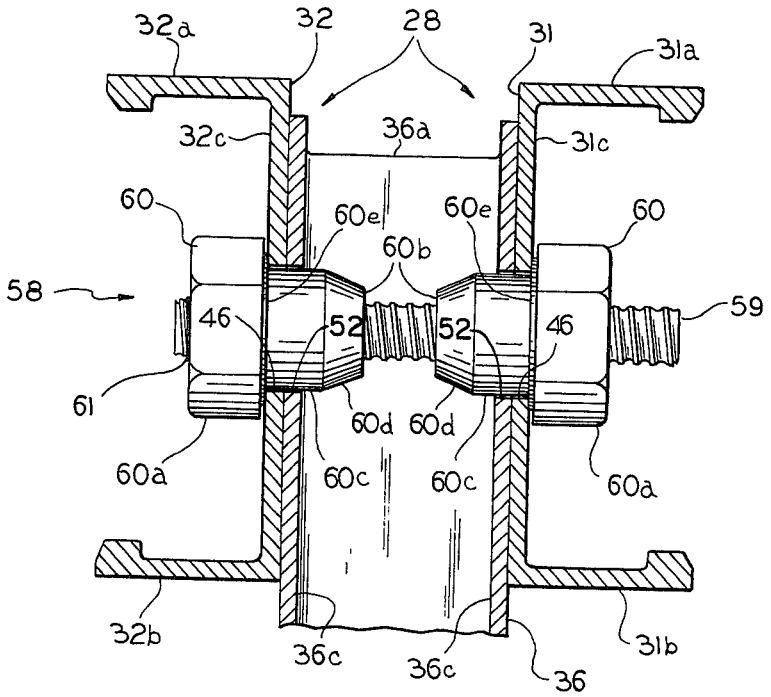
FIGS. 4 and 5 are still further enlarged cross sectional and elevational views of the structure, taken substantially on lines 4—4 and 5—5 of FIG. 2, respectively.
Figure 5:
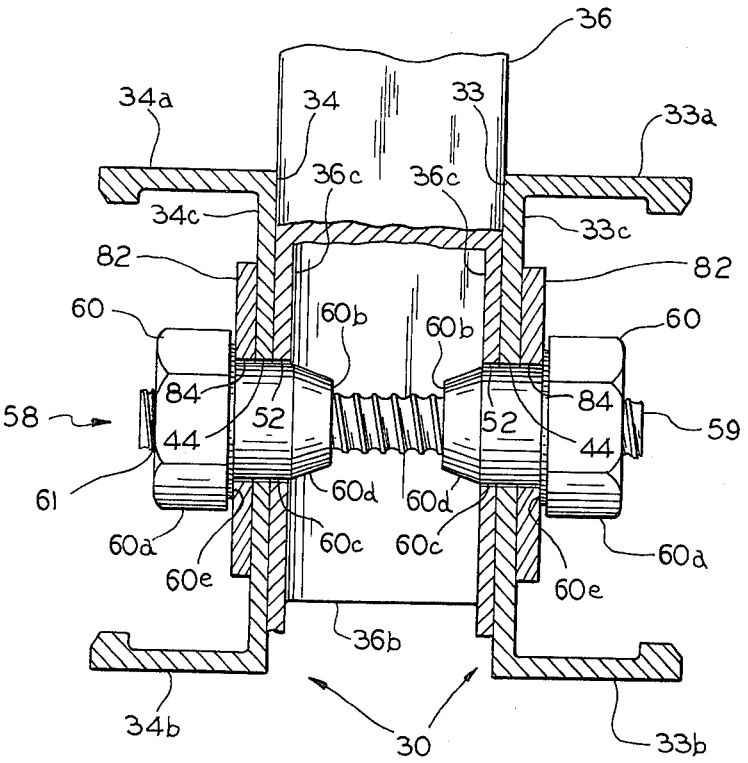
Figure 6:
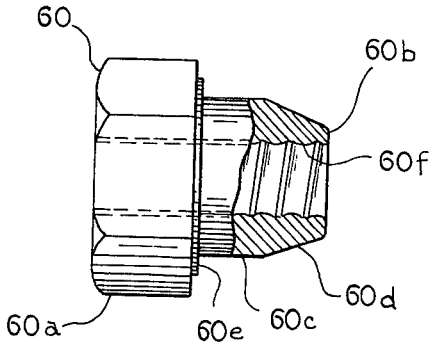
FIGS. 6 and 7 are, respectively, side and end elevational views of a nut component of fastening means employed in the invention, on a larger scale than the preceding views and with a portion of the structure of FIG. 6 broken away and illustrated in section.
Figure 7:
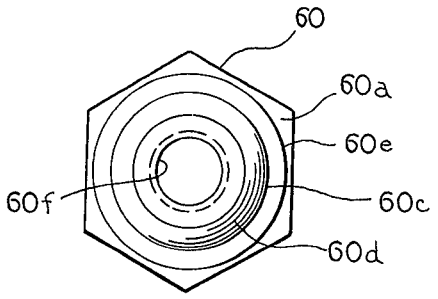
Figure 8:
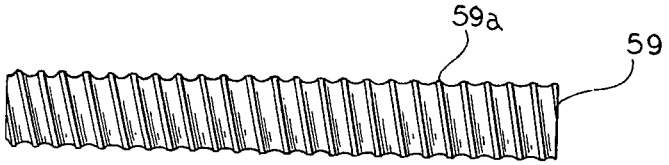
FIG. 8 is a side elevational view of a stem component of the fastening means.
Figure 9:
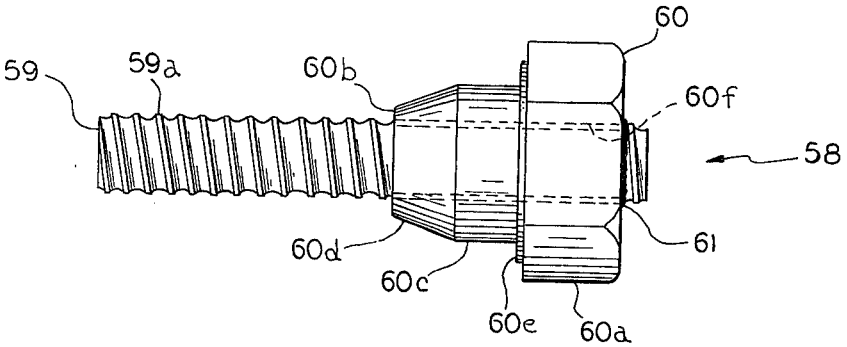
FIG. 9 is a side elevational view of a bolt component of the fastening means, made up of the nut illustrated in FIGS. 6 and 7 and the stem illustrated in FIG. 8.

Each of the upper and lower ends **36*a* and 36*b* of each strut 36 has a pair of registering circular bolt holes 52 in respective spaced parallel opposite side walls 36*c* thereof, which holes are adjacent to the chord webs 31*c* and 32*c*, or 33*c* and 34*c* between which the strut ends extend. Each of the strut end bolt holes 52 also registers with a bolt hole 44 or 46 in the adjacent chord web 31*c*, 32*c*, 33*c*, or 34*c* when the struts 36 and the chords 31–34 are properly aligned, as illustrated in FIGS. 3–5. The bolt holes 52 of adjacent strut ends 36*a* or 36*b* register with alternate chord bolt holes 44 or 46, so that the adjacent strut ends are spaced apart with one chord bolt hole left therebetween. Each strut 36 also has two pairs of registering intermediate bolt holes 54 in the strut side walls 36*c*, adjacent to each of the upper and lower pairs of end bolt holes 52** and spaced inwardly therefrom.

The chords 31–34 and the struts 36 are connected together in the truss-like structure 42 by fastening means which include connecting bolts 58 (FIG. 9) and adjustable connecting nuts 60 (FIGS. 6 and 7) threaded thereon, as most clearly illustrated in FIGS. 3 and 4. Referring to FIGS. 6–9, the fastening means in the illustrative preferred embodiment of the invention include a threaded stem, stud or rod 59 and two connecting nuts 60, one of which nuts preferably is fixed to the stem to provide the connecting bolt 58. The stem 59, also referred to in the industry as a "coil rod", has a contour thread **59*a***, which is preferred for rapid assembly and disassembly.

The connecting nut 60 is integrally constructed in one piece of a hexagonal head **60*a*, a shank 60*b* composed of an inner cylindrical bearing portion 60*c* and an outer conically tapered or frusto-conical drift portion 60*d*, which converges outwardly, and a thin, flat annular shoulder 60*e*. The shank 60*b* is coaxial with the head 60*a*, and projects axially therefrom. The shoulder 60*e* surrounds the shank bearing portion 60*c* on the inner surface of the head 60*a*. A bore 60*f* extends axially through the head 60*a* and the shank 60*b* of the nut 60, and the bore wall is threaded for receiving the stem 59** in threaded engagement therewith.

The connecting bolt 58 is assembled by threading a connecting nut 60 on one end of the stem 59, and fixing the stem to the nut by suitable means, such as a weld 61 where they adjoin or a suitable adhesive applied between the two components. The nut head **60*a* and shank 60*b* become the head and shank, respectively, of the bolt 58. The stem 59 projects axially from the bolt shank 60*b*. Alternatively, a bolt may be made up of a connecting nut 60 rotatably or movably threaded on one end of a stem 59, without fixing one to the other, so that the fastening means is formed of two adjustable connecting nuts 60, rotatable on opposite ends of the stem 59. For convenience, it is preferred, however, to fix one connecting nut 60 to a stud 59, to form the bolt 58, and employ a single adjustable nut 60 therewith. In either case, a manufacturing advantage is achieved, in that the stem 59 is a section of a conventional coil rod, and but one nut 60** need be manufactured to perform both nut and bolt functions.

The head 60a of the connecting nut 60 is enlarged with respect to the diameter of the shank bearing portion 60c, for the purpose of securing the structural members together and properly positioning the fastening means. The shanks 60b of the connecting bolt 58 and the adjustable connecting nut 60 are inserted in bolt holes in the structural members, and the shoulders 60e lie against the surrounding faces of the members and serve to prevent the corners of the head 60a from cutting into the faces. The diameter of the shank bearing portion 60c, reduced with respect to the width of the head 60a, is selected to provide a close fit but less than a drive fit in the bolt holes 44, 46, 52, 84, and 136 (see FIG. 3) in the structural members, enabling the shank portions 60b of the bolt 58 and the adjustable nut 60 to be inserted readily into the holes. For example, a minimum clearance of about 0.010 to 0.020 inch between the bearing portion 60c and the periphery of each opening is preferred.

The drift portion 60d in the illustrative preferred embodiment tapers outwardly from the bearing portion 60c at an angle of about 18° to the longitudinal axis of the nut 60 in the illustrative embodiment. This angle may be varied, depending to some extent upon the length which the drift portion 60d may have within the space requirements, and an angle in the range of about 10° to 30° is preferred.

As explained hereinafter, load forces are transmitted at the shank bearing portion 60c in shear. Consequently, there is relatively little axial force required in the stem 59, and a large stem diameter is not required for structural integrity. The ability to employ a stem of smaller diameter assists in the insertion of the bolt 58 in the bolt holes in the structural members, especially when they are out of complete alignment, and also serves to avoid thread damage during insertion. In the illustrative preferred embodiment, the outer diameter of the stem 59 is approximately one-half of the diameter of the shank bearing portion 60c. Preferably, the stem diameter is a maximum of about three-fourths of the diameter of the bearing portion 60c, and the diameter must be sufficient to avoid breaking the stem when the fastening means is tightened.

Referring to FIGS. 2-4, the bolts 58 are inserted through certain ones of the bolt holes 44 or 46 in the chords 31-34 and the registering bolt holes 52 in the ends of the struts 36, and are secured with the adjustable nuts 60. Referring to FIG. 4 as illustrative of the connections, the shank 60b of the bolt 58 is inserted in a bolt hole 46 in a chord 32 in the upper pair 28, and in a registering bolt hole 52 in an adjacent or adjoining side wall 36c in a strut 36, at the upper end 36a of the strut, with the shank 60b extending inwardly from the head 60a. The shank bearing portion 60c of the bolt fits closely in the bolt holes 46 and 52, as previously described, in load-bearing engagement with the chord web 32c and the strut side wall 36c. Vertically downward load forces applied to the upper flange 32a of the chord 32 by this construction are transmitted via the chord web 32c to the shank bearing portion 60c in shear, from whence the forces are transmitted to the adjacent strut side wall 36c, likewise in shear, and to the strut 36 as a unit.

Load forces likewise are transferred on the opposite side of the strut 36, in spaced apart relation to the transfer of forces on the first side. Thus, the adjustable connecting nut 60, which is movably threaded on the stem 59, is adjusted on the stem with its shank 60b extending inwardly from the head 60a and inserted in a chord bolt hole 46 and a registering strut bolt hole 52. The chord bolt hole 46 is in the remaining chord 31 of the upper pair 28, and it is paired with the hole 46 in which the bolt 58 is inserted. The bolt hole 52 in which the adjustable nut 60 is inserted is formed in the remaining strut side wall 36c, and it is the hole paired with the strut bolt hole 52 in which the bolt 58 is inserted. The bolt or nut shank 60b, in either case, extends from the integral head 60a in the direction of the paired strut bolt hole 52. Vertically downward load forces applied to the upper flange 31a of the remaining chord 31 are transmitted via the chord web 31c and the shank bearing portion 60c of the nut 60 to the adjacent strut side wall 36c in shear, and thence to the strut 36 as a unit. In this manner, the load forces applied to both of the chords 31 and 32 are transmitted to the strut 36.

Referring to FIGS. 1-3, the shoring apparatus unit 16 also includes two elongated tubular legs 62 of rectangular cross section, being square in the illustrative embodiment, which extend vertically in the unit. Each of the legs 62 has a vertical series of pairs of registering support pin holes 64 in opposite walls thereof, there being eight such pairs of holes in the illustrative embodiment, including a lower pair of holes 64a adjacent to the bottom of the leg. The pairs of support pin holes 64 are spaced equidistantly along the length of each leg 62, except for the lower pair of holes 64a and the next adjacent pair of holes 64, which are closer together. At the top of each leg 62, on one of the longitudinally facing sides thereof, a stop block 66 is welded to the leg.

The upper portion of each leg 62 is inserted between the chords 33 and 34 in the lower pair 30 in the shoring apparatus unit 16. Each leg also is inserted between the struts 36 in one of the end strut pairs 37 and 40 at the apex 41 thereof, the spacing between the lower ends of the struts in each pair being suitable for that purpose. The lower portion of each leg 62 in functional position extends below the truss-like structure 42 to provide support therefor. The legs 62 are vertically reciprocally movable relative to the structure 42, for adjusting the combined or overall height of the structure and the legs.

A pair of spaced parallel horizontal strut cross braces 68 in the form of channel bars interconnects the struts 36 in each of the end strut pairs 37 and 40, having legs 62 inserted therebetween. The cross braces 68 are connected at points on opposite sides of the struts 36 and spaced from the upper and lower chord pairs 28 and 30, by means of bolts 70 inserted respectively through holes 74 at opposite ends of the webs of the cross braces and through one pair of the intermediate holes 54 in each strut adjacent to the lower end of the strut, and secured by nuts 75. A vertical leg guide member 76 in the form of a rectangular tube is fixedly mounted on the cross braces 68 therebetween, such as by welding, to provide a leg guide assembly 80. The leg guide member 76 in the illustrative embodiment has a square cross section, and closely receives the leg 62 inserted between the interconnected struts 36 for guided vertical sliding relative movement therein. The stop block 66 prevents the leg 62 from falling out of the guide member 76.

The pairs of support pin holes 64 of the legs 62 register successively with the pairs of bolt holes 44 in the lower chords 33 and 34 which are aligned transversely with the center lines 81 (FIG. 2) of the end strut pairs 37 and 40, as the legs are raised and lowered. The truss-like structure 42 may be supported on the legs 62 at a selected elevation, by inserting a support pin or the like through the latter bolt holes 44 and through a selected pair of the support pin holes 64 in each leg. In the preferred construction, however, a relatively lightweight material is employed for fabricating the chords 31–34, such as an aluminum alloy. In view of the concentration of load stresses at the junctures of the lower chords 33 and 34 with the struts 36 and with the legs 62, it is preferred to employ load transfer members 82, which are in the form of rectangular plates, to transfer the load from the struts 36 to the legs 62. The load transfer members 82 and the legs 62 preferably are constructed of material having relatively high structural strength, and in the preferred embodiment, are constructed of steel. The struts 36, the cross braces 68, and the leg guide member 76, like the chords 31–34, preferably are constructed of extruded aluminum alloy, and together with the load transfer members 82 and the legs 62 provide a relatively light-weight structure having the requisite strength and rigidity.

The load transfer members 82 are employed in pairs connected to the end strut pairs 37 and 40, or other selected strut pairs, between the struts 36 of which the legs 62 are inserted. One member 82 is disposed adjacent to each of webs **33*c* and 34*c* of the lower chords, on the outer side thereof. Each member 82 is provided with three circular bolt holes aligned in an axial row and spaced apart between centers the same distance as the spacing of the bolt holes 44 and 46 in the chords 31–34. Two bolt holes 84 adjacent to opposite ends of each member have the same diameters as the chord bolt holes 44 and 46, and receive bolts 58 or adjustable nuts 60 therethrough. The bolts 58 and nuts 60 which are inserted through the load transfer member holes 84 also are inserted through registering holes 44 in the chords 33 and 34, and through registering holes 52 in the struts 36, as illustrated in FIGS. 3 and 5**.

Referring to FIG. 5, it will be seen that in the resulting assembly of structural members and fastening means at the lower ends **36*b* of the struts 36, the chord webs 33*c* and 34*c*, and the strut side walls 36*c* are engaged by the shank bearing portions 60*c* of the bolts 58 and the adjustable nuts 60 similarly to the engagement of the fastening means with the structural members at the upper ends 36*a* of the struts 36 as illustrated in FIG. 4. In addition, the load transfer members 82 at the lower ends 36*b* of the struts are in load-bearing engagement with the shank bearing portions 60*c* of the bolts and nuts, adjacent to the chord webs 33*c* and 34*c*. With the load transfer members 82 supported independently, as described hereinafter, the vertical load forces in the struts 36 and the lower chords 33 and 34, which constitute the vertical load forces in the truss-like structure 42, are transmitted via the shank bearing portions 60*c* to the load transfer members 82**.

Referring to FIG. 3, a headed support pin 88 is received in the central holes 86 of each pair of load transfer members 82, and the pin also extends through a pair of registering chord bolt holes 44 aligned with a center line 61 (FIG. 2) and a pair of registering support pin holes 64 in the adjacent leg 62. The support pin 88 is detachably secured in place by a clip fastener 92 of conventional construction, having a finger 93 inserted through a hole 90 extending through the inserted end of the pin. A ring 94 attached to the finger 93 is swung down over the end of the support pin in use. The central hole 86 in each load transfer member 82, which receives the support pin 88, is of smaller diameter than the registering chord bolt holes 44. Consequently, the load forces are transferred from the load transfer members 82 to the legs 62 via the support pins 88, while the registering bolt holes 44 merely provide larger openings through the chords, with clearance on all sides to allow free passage of the support pins 88 therethrough. The truss-like structure 42 is vertically adjustably supported on the legs 62 at a selected elevation in the foregoing manner.

The legs 62 also are movable into out-of-the-way or retracted positions on the truss-like structure 42, in which positions the support pin holes **64*a* adjacent to the bottoms of the legs lie between the upper and lower margins of the chords 33 and 34 of the lower pair 30. That is, the lower edge of each leg 62 is elevated at least as far as the bottom surfaces of the lower flanges 33*b* and 34*b* of the lower chord pair, and preferably to locations above such flange surfaces, so that there is no obstruction to rolling the structure 42 on such flanges. The legs are raised for this purpose until the support pins 88 may be inserted through the load transfer members 82 and the lower support pin holes 64*a* in the legs, to support the legs on the structure 42. The structure 42 then may be transported with the legs 62 carried thereby, and in the course of transportation, it may be moved on rollers which rollably engage the lower flanges 33*b* and 34*b* of the lower chord pair 30 without interference from the legs. The length of the legs 62 preferably is selected so that the upper edge or extremity of each leg lies between the upper and lower surfaces of the upper chords 31 and 32 at this time. The legs 62** then do not encounter interference with formwork supported on the upper chords.

A screw jack 100 is provided for engagement with and support of each of the legs 62 on the foundation or floor slab 27 in the illustrative embodiment. Referring to FIG. 3, the jack 100 includes a base plate 101, four upstanding gussets 102 welded thereto at 90° angles therearound, and a screw 103 extending vertically from the center of the base plate and welded thereto and to the gussets. The jack also includes an internally threaded cylindrical nut 104 in threaded engagement with the screw 103, and a pair of handles 105 welded to and extending diametrically outwardly from opposite sides of the nut, for rotation of the nut thereby. The upper end of the screw 103 is received within the lower end of a tubular leg 62, while the lower edges of the leg seat on the nut 104. The jacks 100 provide for fine adjustment of the overall height of the shoring apparatus unit 16, whereas the legs 62 provide for coarse adjustment thereof. When the unit 16 is transported from place to place, the jacks 100 may be carried in a suitable receptacle supported on the unit.

FIG. 3 also illustrates a splice member 134, which may be employed for connecting additional chords, not shown, to the chords 33 and 34 of the lower pair 30 in end-to-end relation. Splicing may take place, for example, when another shoring apparatus unit, such as the unit 16, is connected to the unit illustrated in a continuous assembly. In such case, load forces are transmitted between abutting chords via the splice member 134.

The splice member 134 is in the form of a rectangular tubular bar having a width in a transverse direction with respect to parallel side walls **134*a* thereof which is equal to the width of a strut 36 as measured in a transverse direction with respect to its side walls 36***c*. The side walls 134*a* of the splice member 134 are provided with circular bolt holes 136 which are adapted for registering with certain of the bolt holes 44 in abutting chords. The connecting bolts 58 and the adjustable connecting nuts 60 are inserted through registering chord bolt holes 44 and splice member bolt holes 136 in the same manner as for the connections to the strut members 36. The bolts 58 and nuts 60 serve to connect the chords and the splice member together, and to transfer load forces therebetween at spaced apart points on opposite sides of the splice member via the shank bearing portions 60*c*.

In assembling the shoring apparatus unit 16, the bolts 58 may be inserted first, with the stems 59 thereof being inserted through the chord bolt holes 44 and 46 and the registering bolt holes of other members, on both sides of the unit. Owing to the relatively small diameter of the stem 59, the registering bolt holes in the several members need not be in precise alignment initially, but may be offset with respect to each other while receiving the stem without injury to its thread. The bolt shank drift portion 60*d* serves to align the bolt holes in adjacent walls or webs on one side of the unit, such as the holes 46 and 52 in the chord web 32*c* and the adjacent strut side wall 36*c* illustrated in FIG. 4, and the holes 84,44 and 52 in the load transfer member 82, the chord web 36*c*, and the adjacent strut side wall 36*c* illustrated in FIG. 5. The bolt is not required in any application to align the bolt holes on the opposite side of the unit as well, and the bolt shank bearing portion 60*c* need be inserted but a relatively small distance through bolt holes in the members.

Preferably but not necessarily after insertion of the shank 60*b* of each bolt 58 in registering bolt holes on one side of the unit, an adjustable nut 60 is threaded on the stem 59 for insertion into the registering bolt holes on the opposite side of the unit. As the nut 60 is tightened, the shank drift portion 60*d* thereof serves to bring into alignment the bolt holes on the opposite side, and the nut shank bearing portion 60*c* then enters the bolt holes. Alternatively, both the nut component 60 of the bolt 58 and the adjustable nut 60 may remain outside of the bolt holes on opposite sides of the unit initially, when the adjustable nut 60 is first threaded on the stem 59. As the adjustable nut 60 is tightened on the bolt 58 thereafter, the drift portions 60*d* of the bolt and the nut may function at about the same time to align the bolt holes on both sides of the unit, followed by entry of the bolt and nut shank bearing portions 60*b* into the holes. The operation is rapid and relatively easy employing either procedure, as compared to working a bolt having a long bearing shank through the adjacent walls or webs at spaced apart points. Also, relatively little thread damage is experienced.

It is preferred to tighten the fastening means so that the shoulders 60*e* on the bolt 58 and the adjustable nut 60 are snug against the outer faces of the adjacent structural members, and then tighten the nut relative to the bolt another quarter turn. No torque is specified, inasmuch as the load forces are transferred through the shank bearing portions 60*c*. When the structure is assembled in this manner, the contractor can be assured that complete bearing support has been provided for the structural members.

While the invention has been illustrated and described with reference to a particular shoring apparatus unit 16 having several types of connections between structural members, it will be apparent that the invention is applicable to various other load-bearing structures. Also, while preferred embodiments of the fastening means have been described and illustrated, it will be apparent to those skilled in the art that changes and modifications may be made therein within the spirit and scope of the invention. It is intended that all such variations, changes and modifications be included within the scope of the appended claims.

Having thus described the invention, what I claim as new and desire to secure by Letters Patent is:

1. In a load-bearing structure including horizontally extending chord means having a pair of spaced apart vertical webs, and a tubular member having spaced parallel opposite walls and extending outwardly from said chord means, said member having an end disposed between said webs with said walls each adjacent to one of the webs, said end having a pair of registering circular bolt holes in respective walls and adjacent to said webs, said webs each having a circular bolt hole registering with each adjacent wall bolt hole, said pair of wall bolt holes and said web bolt holes registering therewith being adapted for receiving therein threaded bolt and nut-type fastening means serving to connect said chord means and said member together in a structure adapted for supporting a load on said chord means, and also serving to transfer load forces between said webs and said walls on both sides of said member, fastening means inserted in said pair of wall bolt holes and said web bolt holes registering therewith, and comprising:

a bolt having
- a head,
- a shank integral with said head and projecting axially therefrom, said shank including a cylindrical bearing portion of reduced diameter, and
- a threaded stem of further reduced diameter projecting axially from said shank, and a nut having
- a head, and
- a shank integral with said nut head and projecting axially therefrom, said nut shank including a cylindrical bearing portion of reduced diameter the same as the diameter of said bolt shank bearing portion,
- said nut head and shank having a threaded bore extending axially therethrough and adapted for receiving said stem in threaded engagement with the nut;

said bolt shank being inserted through one of said wall bolt holes and said web bolt hole registering therewith in load-bearing engagement of its bearing portion with the wall and the web having the holes therein, and extending from said bolt head in the direction of the paired wall bolt hole, said nut shank being inserted through said paired wall bolt hole and said web bolt hole registering therewith in load-bearing engagement of its bearing portion with the wall and the web having the holes therein, and extending from said nut head in the direction of said one wall bolt hole, said nut receiving said stem in threaded engagement in said bore.

2. A structure as defined in claim 1 and wherein said tubular member comprises a strut extending obliquely from said chord means.

3. A structure as defined in claim 1 and wherein said stem is fixed to said bolt head and shank.

4. A structure as defined in claim 1 and wherein said bolt shank and said nut shank each include an outer conically tapered drift portion.

5. A structure as defined in claim 4 and wherein said stem is fixed to said bolt head and shank.

6. In a load-bearing structure including upper and lower spaced apart horizontally extending chord means each having a pair of spaced apart vertical webs, and a plurality of rectangular tubular struts extending from said upper chord means to said lower chord means, each of said struts having opposite ends disposed between said webs of the upper and lower chord means respectively and having opposite side walls adjacent to the webs, each of said ends having a pair of registering circular bolt holes in respective side walls and adjacent to said webs, said webs each having a circular bolt hole registering with each adjacent strut bolt hole, each of said pairs of strut bolt holes and said web bolt holes registering therewith being adapted for receiving therein threaded bolt and nut-type fastening means serving to connect the chord means and struts together in a truss-like structure adapted for supporting a load on said upper chord means, and also serving to transfer load forces between said webs and said side walls on both sides of the struts, fastening means inserted in each pair of said strut bolt holes and said web bolt holes registering therewith, and comprising:

a bolt having
- a head,
- a shank integral with said head and projecting axially therefrom, said shank including a cylindrical bearing portion of reduced diameter, and
- a threaded stem of further reduced diameter projecting axially from said shank, and a nut having
- a head, and
- a shank integral with said nut head and projecting axially therefrom, said nut shank including a cylindrical bearing portion of reduced diameter the same as the diameter of said bolt shank bearing portion,
- said nut head and shank having a threaded bore extending axially therethrough and adapted for receiving said stem in threaded engagement with the nut;

said bolt shank being inserted through one of said strut bolt holes in each pair and said web bolt hole registering therewith in load-bearing engagement of its bearing portion with the side wall and the web having the holes therein, and extending from said bolt head in the direction of the paired strut bolt hole, said nut shank being inserted through said paired strut bolt hole and said web bolt hole registering therewith in load-bearing engagement of its bearing portion with the side wall and the web having the holes therein, and extending from said nut head in the direction of said one strut bolt hole, said nut receiving said stem in threaded engagement in said bore.

7. A structure as defined in claim 6 and wherein said stem is fixed to said bolt head and shank.

8. A structure as defined in claim 6 and wherein said bolt shank and said nut shank each include an outer conically tapered drift portion.

9. A structure as defined in claim 8 and wherein said stem is fixed to said bolt head and shank.

10. A structure as defined in claim 6 and wherein each of said chord means comprises a pair of spaced apart parallel channel-shaped chords having flanges extending horizontally outwardly from said webs.

11. A structure as defined in claim 10 and wherein said bolt shank and said nut shank each include an outer conically tapered drift portion.

12. A structure as defined in claim 11 and wherein said stem is fixed to said bolt head and shank.

13. A structure as defined in claim 10 and including a pair of plate-like load transfer members extending between two of said struts at the lower ends and on the opposite sides thereof, said load transfer members each having two circular bolt holes registering respectively with said bolt holes in the lower ends of the struts and with said web bolt holes registering therewith, said bolt and nut shanks also being inserted through the bolt holes of respective load transfer members in load-bearing engagement of their bearing portions with the members for transferring the load forces between the truss-like structure and the members.

14. A structure as defined in claim 13 and wherein said bolt shank and said nut shank each include an outer conically tapered drift portion, and said stem is fixed to said bolt head and shank.

* * * * *